United States Patent [19]

Neumann

[11] 4,093,423

[45] June 6, 1978

[54] CATALYTIC DEVICE FOR THE CATALYTIC PURIFICATION OF EXHAUST GASES

[75] Inventor: Joachim Neumann, Stöckheim, Germany

[73] Assignee: Volkswagenwerk Aktiengesellschaft, Wolfsburg, Germany

[21] Appl. No.: 403,270

[22] Filed: Oct. 3, 1973

[30] Foreign Application Priority Data

| | | |
|---|---|---|
| Dec. 7, 1972 | Germany | 2259817 |
| Oct. 3, 1972 | Germany | 2248442 |
| Apr. 18, 1973 | Germany | 2319663 |

[51] Int. Cl.[2] ..... B01J 8/03; B01J 35/04; F01N 3/15; B21D 53/00

[52] U.S. Cl. ..... 23/288 FC; 29/157 R; 60/299

[58] Field of Search ..... 23/288 FC; 60/299; 138/147, 149, 115, 177; 423/213.2, 213.5, 213.7; 29/451, 455, 157

[56] References Cited

U.S. PATENT DOCUMENTS

| | | | |
|---|---|---|---|
| 2,324,181 | 7/1943 | Tulien | 138/147 X |
| 3,189,418 | 6/1965 | Gary | 23/288 FC UX |
| 3,233,699 | 2/1966 | Plummer | 138/149 X |
| 3,247,665 | 4/1966 | Behrens | 23/288 FB X |
| 3,441,381 | 4/1969 | Keith et al. | 23/288 FC |
| 3,441,382 | 4/1969 | Keith et al. | 23/288 FB |
| 3,692,497 | 9/1972 | Keith et al. | 23/288 FC |
| 3,741,287 | 6/1973 | Mittman | 29/451 X |
| 3,771,967 | 11/1973 | Nowak | 23/288 FC |
| 3,787,944 | 1/1974 | Mittman | 29/451 X |
| 3,798,006 | 3/1974 | Balluff | 23/288 FC |
| 3,801,289 | 4/1974 | Wiley | 23/288 FC |

*Primary Examiner*—Morris O. Wolk
*Assistant Examiner*—Michael S. Marcus
*Attorney, Agent, or Firm*—Brumbaugh, Graves, Donohue & Raymond

[57] ABSTRACT

A catalytic unit for treating gases, particularly exhaust gases of internal combustion engines, containing a monolithic carrier coated with an active catalytic agent, is mounted within a housing by a flexible or elastic, heat-resistant jacket and axially extending slide members interposed between the coated carrier and the housing. The heat-resistant jacket is advantageously prestressed when placed within the housing.

8 Claims, 6 Drawing Figures

CATALYTIC DEVICE FOR THE CATALYTIC PURIFICATION OF EXHAUST GASES

BACKGROUND OF THE INVENTION

This invention relates in general to catalytic apparatus for treating gases and, in particular, to improved structures for mounting actively coated monolithic carrier material in a housing.

As is well known, purification of exhaust gases from internal combustion engines, particularly in motor vehicles, is today generally achieved by afterburning. This afterburning may be hastened by feeding the exhaust gases in such a system through catalysts consisting of a carrier which is coated with a catalytic substance that effects a chemical conversion of the noxious gas constituents. In such a system, the carrier may either be a loose material or a monolith with channels passing through it. In the automotive field, catalysts with monolithic carriers have proved particularly advantageous in this connection. These carriers are housed in gas-tight, sheet-metal or cast-metal, heat-resistant housings whereby they can be connected to the exhaust system of the internal combustion engine. However, when the monolithic carrier is mounted in the casing, several problems arise as a result of the fraility of the carrier material.

Carriers that currently are employed, consist of a porous ceramic material having limited mechanical strength. Thus, it is not possible to exert clamping forces on them with sufficient strength to assure a secure, solid mounting of the carriers. On the other hand, the catalyst must be arranged in the immediate vicinity of the internal combustion engine so that its start-up time, following the starting of the engine, will be short. Accordingly, the vibrations emanating from the internal combustion engine are transmitted to the catalyst housing and these vibrations can damage the carrier structure. In order to prevent such damage to the carrier, the carrier must be mounted flexibly or elastically. A mounting of this sort also serves the need to accommodate the relatively large cross-sectional tolerances of the carrier which occur during the manufacturing process and the differences in thermal expansion that result from the different coefficients of thermal expansion of the carrier material and the metal housing.

In one known catalytic apparatus (German Provisional Pat. No. 1,476,507, U.S. Pat. No. 3,441,381 to Keith et al.), the carrier is held in a cylindrical housing having, in the annular space between the housing and the carrier body, a springy corrugated jacket preferably made of wire mesh, which tightly surrounds the carrier body. It has been found, however, that such an intermediate layer consisting of a springy wire mesh does not solve the above-described mounting problems as the high temperature in the catalyst causes the wire mesh to burn out. If this wire mesh were made of a material that would not be affected by high temperatures, a catalyst of this type, which is intended for mass use, would be far too expensive.

These and other shortcomings of the prior art are overcome by the present invention.

SUMMARY OF THE INVENTION

It is accordingly an object of the present invention to provide a simple and economical, elastic or flexible mounting for a catalyst carrier, which will withstand these high mechanical and thermal stresses.

It is a further object to provide a mounting unit having the foregoing characteristics which are particularly adapted for use with internal combustion engines and especially motor vehicles.

These objects, as well as other objects which will become apparent in the discussion that follows, are achieved according to the present invention by providing a prestressed jacket that surrounds the carrier and is arranged in an interstice between the carrier and the housing, said jacket being made from an elastic material that is resistant to high temperatures.

In a further development of the invention, the jacket is made from a fibrous ceramic material. In this case the jacket may consist of one or more layers of a mat made up of ceramic fibers. A particularly preferred jacket is made of a fibrous material comprised of aluminum silicate (Fiberfrax®). The advantages of this elastic or flexible mounting include particularly good thermal resistance and thermal insulating effect. Additionally, this jacket provides good packing of the interstice between the carrier and the housing for the gas flowing through the housing. Lastly, this material is economical and, consequently, is especially well suited for large-scale manufacture.

It is a feature of the invention that sliding segments are provided, extending axially along the periphery of the jacket and making it possible to insert the carrier together with the jacket into the housing in the axial direction. The sliding segments may be provided with an inward-oriented collar encircling the jacket at least at one end. By means of this collar, it is possible to apply an axial pressure to the sliding segments, for example, with the aid of a pressure plate, without creating a danger that the carrier itself will undergo pressure in the axial direction and thus be damaged.

In accordance with another embodiment of the invention, the outer covering of the jacket may be hardened, at least in segments, in lieu of the above-described sliding-segment arrangement. In this embodiment, the hardened zones of the outer covering of the jacket fill the function of said sliding segments by similarly exerting on the jacket a radial stress that is distributed as evenly as possible over the periphery thereof, so as to effect uniform compression of the fiber mat and consequently center the carrier within the housing as much as possible. Furthermore, the sliding segments facilitate the introduction of the jacketed carrier into the housing and therefore prevent any slippage of the jacket as a result of friction with the walls of the housing.

Insertion of the jacketed carrier, in accordance with this invention, may be acccomplished by placing the carrier, provided with the jacket, together with the sliding segments in a conical guide sleeve which reduces the outer diameter of the jacket to the inner diameter of the housing, and then pressing into the casing, in the axial direction, the sliding segments. This procedure facilitates simple, economical manufacture of the elastic mounting of the carrier in the casing while protecting it from damage.

In another embodiment of the present invention, the casing can be made in the form of a cylindrical sheet-metal shell from a prerolled rectangular piece of sheet metal, said shell being circumferentially prestressed around the jacketed carrier. In this embodiment, the above-described sliding segments are eliminated. The jacketed carrier is not inserted into a finished catalyst housing, but, instead the housing consists of a cylindrical sheet-metal shell that is fabricated from a prerolled rectangular piece of sheet-metal together with the flexibly mounted carrier in a jig or stretching device, thus being wrapped immediately around the jacketed support. In this way additional sliding segments and inserting devices for assembly are eliminated.

It is a feature of this embodiment of the present invention that the ends of the rectangular piece of sheet metal must substantially overlap in a stretched state and then be fastened to one another for the purpose of preventing the jacket material, consisting of the fibrous ceramic substance, from being squeezed out between the two peripherally located ends of the rectangular piece of sheet metal consituting the housing during the wrapping operation.

In another feature of the present invention, the radial ends of the cylindrical sheet-metal shell may be provided with conical transition pieces which have radially inward directed collars covering the jacket. Such collars shield the jacket from the hot, flowing, combustion gases and thus prevent the fibrous ceramic material from becoming brittle and crumbling.

In order to make sure that the monolithic carrier is held satisfactorily and securely in the axial direction in the housing, even after considerably long periods of operation, it is advantageous to have the jacket bound to the carrier or the housing or both by a cement. This cementing of the jacket with the carrier or the housing or both substantially improves the mounting of the carrier in the housing, and is essentially independent of the nature or quality of the frictional connection therebetween. Thus, this easily achieved union guarantees that the monolithic carrier will be held securely and firmly in the axial direction when the prestress forces decrease following a relatively long period of operation of the catalyst and such settling of the jacket material as may have occurred as a result thereof.

The cementing can simply be achieved by the application of heat-resistant cement, such as a refractory cement, to at least one of the two mutually facing peripheral surfaces of the jacket and the housing or the carrier and the jacket, as the case may be. Another possibility for effecting a cement binding, at least between the jacket and the housing, consists, in accordance with another feature of the present invention, in heating the housing surrounding the jacket for a short time to a temperature of approximately 500° C., so that they are cemented together by sintering. Through the heating of the finished and mounted housing to a temperature of approximately 500° C, in the manner provided in accordance with the present invention, an adequate binding is easily achieved between the housing and the jacket as a result of a sinter-like cementing operation of the jacket consisting of a ceramic fibrous material made of alumina and silica.

BRIEF DESCRIPTION OF THE DRAWINGS

For a better understanding of the invention, reference may be made to the following description of exemplary embodiments thereof taken in conjunction with the accompanying drawings, in which.

DESCRIPTION OF EXEMPLARY EMBODIMENTS

Figure 1:
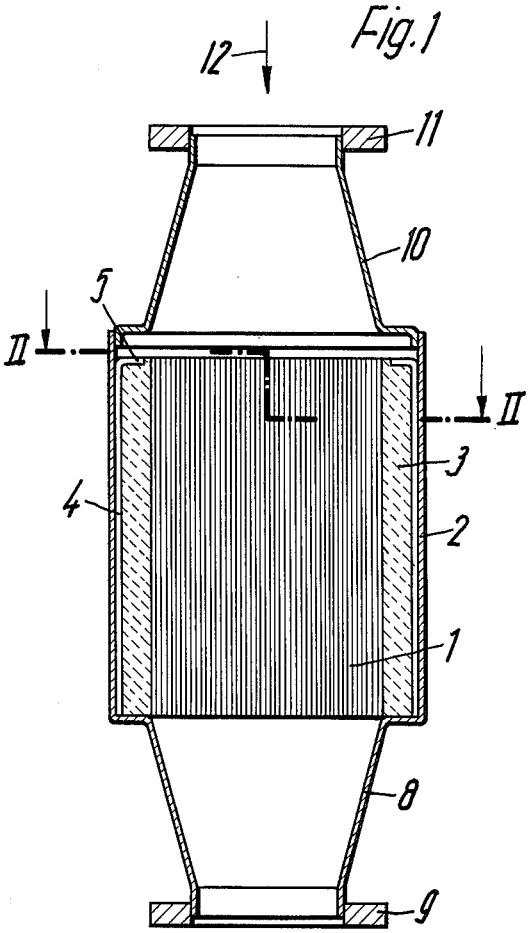
FIG. 1 is a longitudinal sectional view of a catalyst having a monolithic carrier flexibly mounted in a housing.

In the drawings, the same reference numerals are used for the same functional parts.

FIG. 1 illustrates a finished catalyst which can be connected to an exhaust pipe by means of flanges 9 and 11. In this figure, the monolithic carrier 1 with channels running through it from end to end in the axial direction, is mounted in a flexible, elastic manner in housing 2 by means of elastic jacket 3. Elastic jacket 3 is capable of withstanding high temperatures. As the passage of the exhaust gas through the body of catalyst 1 is associated with a pressure drop which leads to a reduction in the thermodynamic efficiency of the internal combustion engine, the cross-sectional area of the catalyst is made considerably greater than the cross-sectional area of the exhaust-gas inlet and outlet pipelines (not shown). This helps to keep said pressure drop to a minimum. Consequently the transition from the exhaust pipe to housing 2 is provided with conical transition pieces 8 and 10 on both the gas inlet and gas outlet sides. While the cross-section of the body of catalyst 1 and of housing 2 normally is circular, other cross-sectional shapes of the catalyst, such as oval or rectangular shapes, for example, may be used. Arrow 12 indicates the direction of flow of the exhaust gas through the catalyst.

Figure 2:
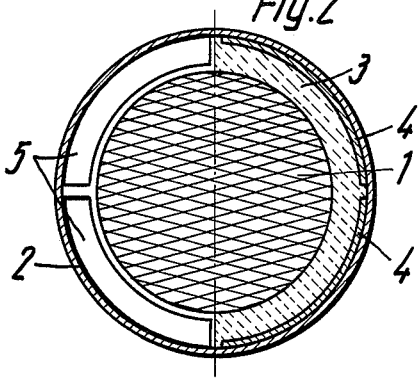
FIG. 2 is a transverse section through the catalyst taken along line II — II in FIG. 1.

Around the periphery of jacket 3, which in accordance with the invention consists of an elastic, fibrous ceramic material that is under previously-induced radial stress and is resistant to high temperatures, there are provided sliding segments 4 extending axially and, as can be more clearly seen from FIG. 2 almost completely encompassing jacket 3 with the exception of small axial slits left between the sliding segments. In the exemplary embodiment illustrated in the drawing, four evenly distributed sliding segments 4 are provided around the periphery of jacket 3 and have radially inward-oriented collars 5 at one end. These collars cover a portion of the end face of jacket 3 and serve as a contact surface for the application of an axial pressure when carrier 1 is pressed into housing 2.

Figure 3:
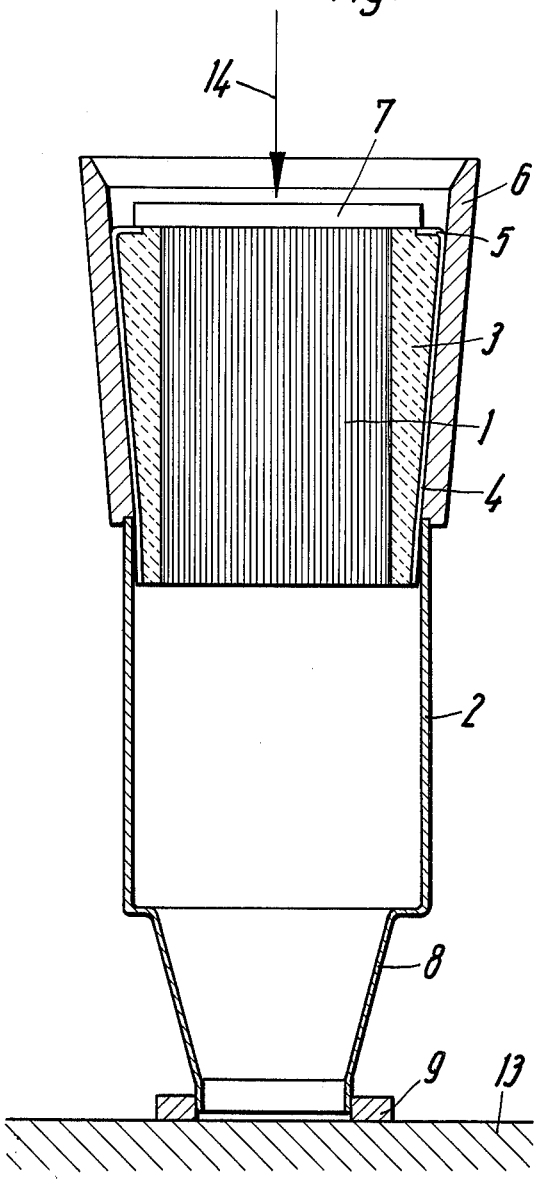
FIG. 3 is a longitudinal sectional view which illustrates the insertion of the carrier into the housing.

The operation of pressing carrier 1 into the housing 2 is illustrated in FIG. 3, wherein housing 2 is mounted on a stationary base plate 13 by flange 9 which is fixed to conical transition piece 8. A conical guide sleeve 6 is placed over the feed opening of housing 2. Carrier 1 is introduced into housing 2 in the following manner: Carrier 1 is provided with jacket 3 together with sliding segments 4 and is placed in guide sleeve 6. The carrier 1 then is pressed into housing 2 by application of an axial pressure corresponding to arrow 14 with the aid of a pressure plate 7 placed on collars 5 of sliding segments 4. Thus sliding segments 4 slide first of all into contact with the conical inner wall of guide sleeve 6. This effects a decrease in the outer diameter of jacket 3 to the inner diameter of housing 2 and ultimately brings sliding segments 4 into contact with the inside wall of housing 2. Accordingly, a radial stress is evenly distributed over the periphery of elastic jacket 3, compressing the jacket material without damaging carrier 1. Damage to carrier 1, which is especially sensitive to axial stress, is avoided as a result of the limitation to radial stress which is achieved by the above-described method. If damage to carrier 1 did occur, it would cut down on the operating efficiency of the catalyst.

As trials have shown, the elastic mounting of the catalyst carrier is able to durably withstand the considerable thermal and mechanical stresses which especially occur in an exhaust-gas purification system for motor vehicles. The material for the elastic jacket used in these trials was a mat of ceramic fibers made of aluminum silicate which were wound around carrier 1 in one or more layers. In addition to a high degree of thermal resistance and good elasticity, this material also showed heat insulation that was advantageous for the operation of the catalyst and good packing of the space between carrier 1 and housing 2. This tight packing is necessary to prevent a portion of the exhaust gases from being able to circumvent the catalyst carrier, as can occur when the known elastic wire mesh mat is used without provision of precautionary measures. Lastly, the simple and careful fashioning of the carrier mounting, in accordance with the invention, with the use of the sliding segments and the conical guide sleeve together with the comparatively economical material for the jacket facilitate economical manufacture of a catalyst on a large scale.

Figure 4:
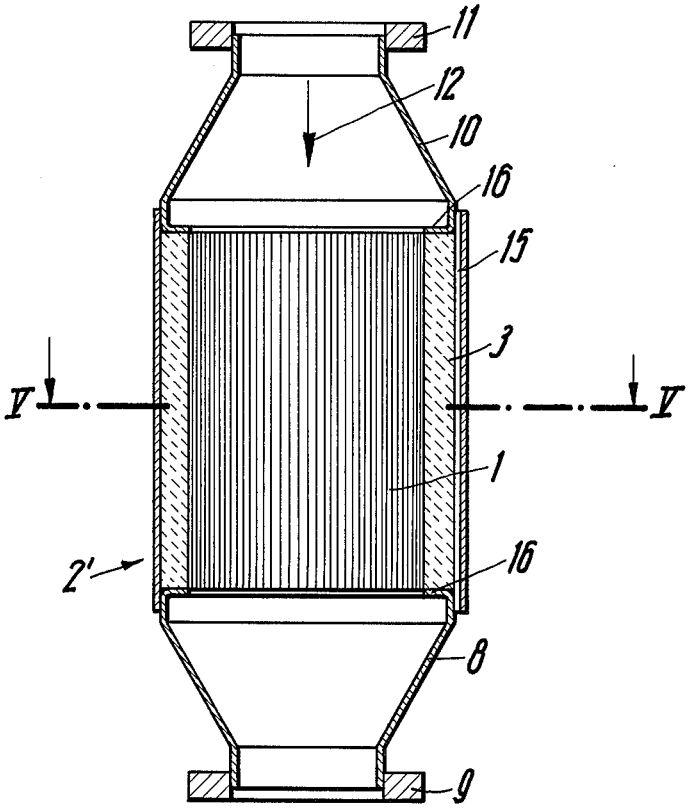
FIG. 4 is a longitudinal sectional view of a catalyst, the housing of which consists of a metal plate wrapped around the carrier.
Figure 5:
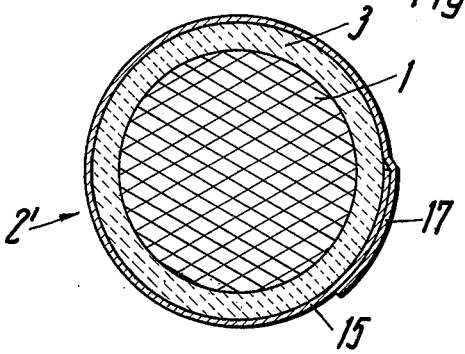
FIG. 5 is a transverse section through the catalyst taken along line V — V in FIG. 4.

In contrast to the embodiment illustrated in FIGS. 1 and 2, housing 2' in the embodiment of FIGS. 4 and 5 is comprised of a cylindrical sheet metal shell 15 which is rolled from a rectangular piece of sheet metal. In this embodiment, the body of carrier 1, enveloped in jacket 3, is placed in a prerolled, open rectangular piece of sheet metal. Subsequently, the rectangular piece of sheet metal is wound around carrier 1 and jacket 3 by having its ends 17 pulled together in a jig or stretching device. In this manner, the heat resistant ceramic fiber mat of jacket 3 is compressed so that it now securely holds carrier 1 in an elastic, flexible manner. During this process, both ends 17 of the rectangular piece of sheet metal are pulled together so that, as illustrated in FIG. 5, they considerably overlap, thus preventing jacket 3 from being squeezed out during the stretching and pulling operation. After the two ends 17 of the rectangular piece of sheet metal are fastened together, for example, by welding, conical transistion pieces 8 and 10 are placed on the ends of the resulting cylindrical sheet metal shell 15 and secured thereon by welding. The transition pieces 8 and 10 have radially inward-projecting collars 16 which cover the end surfaces of jacket 3. These collars prevent the hot combustion gases flowing through housing 2' from coming into direct contact with jacket 3 and causing a hardening and embrittlement of the fibrous material, which might in turn cause jacket 3 to crumble and leak out of housing 2'.

As previously stated, jacket 3, utilized in accordance with FIGS. 4 and 5, is able, due to the fibrous aluminum silicate mat, to durably withstand the intense thermal and mechanical stresses which particularly are present in an exhaust-gas purification system for motor vehicles. The housing 2' construction shown here also makes possible simple, rapid, and economical assembly, in which cylindrical sheet-metal shell 15 constituting housing 2' is manufactured with carrier 1 flexibly mounted therein in a single operation which creates no danger of damage to the delicate carrier material. Furthermore, this embodiment makes possible the fairly precise maintenance of a specified stress for jacket 3, and this, owing to the comparatively broad tolerance range of monolithic carrier diameters, is of great advantage as it eliminates many tolerance problems of the carrier diameter in relation to the housing diameter.

In a modification of the embodiment shown in FIG. 4, with collars 16 projecting radially inward on both transition pieces 8 and 10, the catalyst also could be manufactured with only one collar 16 provided on one end of cylindrical sheet metal shell 15; preferably on transition piece 10 located on the upstream side. In a further modification, no collar at all is provided. Moreover, it also is possible to construct the catalyst housing similarly to the embodiment of FIG. 1, with one or both transition pieces having collars projecting radially outward; the radially outermost peripheral edge of these collars then being fastened to sheet metal shell 15.

Figure 6:
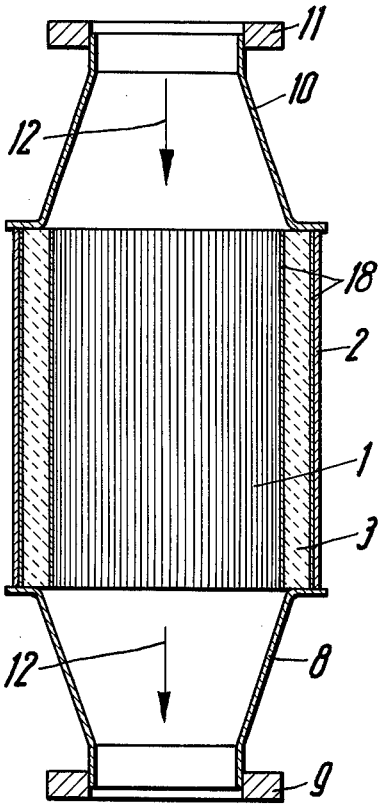
FIG. 6 is a longitudinal sectional view of a catalyst similar to the one in FIG. 4 in which cement bindings are provided on the mutually facing peripheral surfaces of the housing, the carrier and the jacket.

FIG. 6 illustrates an embodiment of the present invention in which the surface of carrier 1, jacket 3 and housing 2', which come together to form the apparatus, are cemented together to improve the mounting of carrier 1 in housing 2'. This cementing, which is effected by application of an adhesive 18 having high thermal resistance, for example, a refractory cement, results in a substantial strengthening of the frictional seal between carrier 1 and jacket 3 or jacket 3 and the housing 2', as the case may be. Thus, forces capable of causing an axial shift of carrier 1 in housing 2' will necessarily be substantially greater. Accordingly, the danger that carrier 1 might slip out of its mounting is markedly reduced.

Housing 2' and jacket 3 may simply be cemented together without the use of a special adhesive subjecting housing 2' of the finished catalyst, over a short period, to heating to a temperature of approximately 500° C. At such temperatures, a sinter-like process takes place whereby jacket 3 is cemented to housing 2'.

Under some circumstances, it is not necessary to cement the circumferential surfaces of jacket 3 and carrier 1, which face one another, as the outside surface of carrier 1 is generally comparatively rough and, consequently, there exists a high coefficient of friction between jacket 3 and carrier 1. This coefficient of friction, in combination with the radial prestress of jacket 3, would make any axial shifting between these parts very difficult. The inner surface of the housing 2', on the other hand, is comparatively smooth, so that even small forces might cause jacket 3 and housing 2' to shift relative to one another. A roughening of the inner shell of the casing, in addition to cementing, if so desired, would provide a further improvement of the mounting.

Problems similar to those related to the catalysts described herein also occur in connection with rotary heat exchangers, which primarily are used in thermal engines. The heat accumulators that are used in such engines frequently consists of ceramic masses which are similar, or at least comparable in structure, to monolithic catalyst carriers and are likewise exposed to considerable mechanical and thermal stresses. Consequently, in order to guarantee a secure, economical mounting for these delicate ceramic heat accumulators, the solution proposed by the present invention might be applied to advantage. Accordingly, the invention is not restricted solely to applications involving catalysts.

The ceramic carrier held by the elastic ceramic fiber jacket of the present invention may consist of several individual pieces, for example, disc-shaped pieces arranged at a distance from one another, which then are wrapped within a single fiber mat and held in a common housing.

Although the invention has been described with reference to specific embodiments thereof, many modifications and variations of such embodiments may be made by those skilled in the art without departing from the inventive concepts disclosed. Accordingly, all such modifications and variations are intended to be included within the spirit and scope of the appended claims.

I claim:

1. A method of supporting a ceramic monolithic element in a generally tubular metal catalytic converter housing comprising the steps of: wrapping a compressible, resilient material around the periphery of a monolithic catalyst element; placing at least one self-supporting, thin metal liner member around said wrapper of resilient material, the combination of said monolithic element, said resilient material wrapper and said liner member having a diameter in an uncompressed state greater than the internal diameter of said housing; imposing an external compressive force about said liner member around its periphery to compress said wrapper of resilient material and to reduce the circumference of the liner member to a dimension less than the internal circumference of the converter housing; axially inserting said compressed combination of said liner member, said wrapper of resilient material and said monolithic element into said tubular housing and removing said external compressive force.

2. A method for manufacturing a catalytic unit for treatment of gases passing therethrough, comprising the steps of:

covering the axial surface of a monolithic body with an elastic, heat-resistant means, the body having a plurality of channels passing through it and the channels defining inner surfaces of the body which are coated with an active catalytic agent;

arranging a plurality of sliding members around the circumference of said elastic, heat-resistant means;

placing the covered body and sliding members in a conical guide sleeve, said guide sleeve tapering to approximate the inside diameter of a housing, said guide sleeve being previously placed over one end of said housing so that the axes of said housing and said guide sleeve are colinear;

pressing said sliding members in the direction of said axes until said covered body and sliding members are fully within said housing whereby said elastic, heat-resistant means is under radial stress.

3. In a catalytic converter for treating exhaust gases having a metal housing containing gas inlet and outlet ports and a catalyst coated, axially channeled monolithic ceramic element positioned within said housing, the improvement comprising a wrapper of compressible, resilient material wrapped around said ceramic element, and extending axially for at least a portion of the length of said element, said wrapper being maintained in a partially compressed state as compared to either its free or its fully compressed state, within the walls of a tubular center portion of said housing and also comprising at least one metal liner member shaped to conform generally to and within the walls of the tubular center portion, the said liner member having non-joined longitudinal side edges which permit the diameter of the liner member to be varied, said liner member being positioned in surrounding relation to said wrapper and in contact with said wrapper so as to partially compress said wrapper and to space said wrapper from the walls of said tubular center portion of said metal housing, the resiliency of said wrapper causing said liner member to be forced outwardly to the maximum diametrical extent permitted by the constraint imposed by the center portion of the metal housing.

4. Apparatus for treating the exhaust gases of an internal combustion engine comprising a housing having a gas inlet and a gas outlet; a monolithic body disposed within the housing, the body having a plurality of channels passing through it, the channels defining inner surfaces of the body which are coated with an active catalytic agent; an elastic, heat-resistant means interposed between said body and said housing under radial prestress for resiliently mounting said body in said housing; and axially-extending sliding members provided between said elastic, heat-resistant means and said housing to facilitate insertion of said body together with said elastic, heat-resistant means into said casing.

5. The apparatus of claim 4 wherein at least one end of said sliding members is provided with an inward-directed collar substantially enclosing at least one radial end of said elastic, heat-resistant means.

6. The apparatus defined in claim 4, wherein said elastic, heat-resistant means is comprised of one or more layers of a mat of ceramic fibrous material.

7. The apparatus defined in claim 4, wherein said elastic, heat-resistant means is made of ceramic fibrous material.

8. The apparatus defined in claim 7, wherein said ceramic fibrous material is aluminum silicate.

* * * * *